US012070641B2

(12) United States Patent
Wallace

(10) Patent No.: US 12,070,641 B2
(45) Date of Patent: Aug. 27, 2024

(54) MULTI-FUNCTION AT-HOME PLAYSET KIT

(71) Applicant: Be Wood, LLC, Scarborough, ME (US)

(72) Inventor: Brian Wallace, Scarborough, ME (US)

(73) Assignee: BE WOOD, LLC, Scarborough, ME (US)

( * ) Notice: Subject to any disclaimer, the term of this patent is extended or adjusted under 35 U.S.C. 154(b) by 91 days.

(21) Appl. No.: 17/881,348

(22) Filed: Aug. 4, 2022

(65) Prior Publication Data

US 2023/0040497 A1 Feb. 9, 2023

Related U.S. Application Data

(60) Provisional application No. 63/229,084, filed on Aug. 4, 2021.

(51) Int. Cl.

| | |
|---|---|
| ***A63B 17/04*** | (2006.01) |
| ***A63B 4/00*** | (2006.01) |
| ***A63G 11/00*** | (2006.01) |

(52) U.S. Cl.

CPC ..... *A63B 17/04* (2013.01); *A63B 4/00* (2013.01); *A63G 11/00* (2013.01)

(58) Field of Classification Search

CPC ..... A63B 17/04; A63B 4/00; A63B 26/003; A63G 11/00; A63G 31/00

See application file for complete search history.

(56) References Cited

U.S. PATENT DOCUMENTS

| | | | | | |
|---|---|---|---|---|---|
| 2,415,639 | A * | 2/1947 | Lanman | A63G 11/00 | 472/109 |
| 2,425,884 | A * | 8/1947 | Janssen | A47C 1/024 | 297/411.42 |
| 4,234,148 | A * | 11/1980 | Maddestra | G09F 1/14 | 248/459 |
| 4,305,581 | A * | 12/1981 | Neuharth | A63D 15/04 | 473/15 |
| 4,630,819 | A * | 12/1986 | Levin | A63B 9/00 | 182/152 |
| 4,671,506 | A * | 6/1987 | Sutherland | A63G 1/12 | 472/18 |
| 4,877,237 | A * | 10/1989 | Goble | A63G 9/00 | 297/157.1 |
| 5,194,048 | A * | 3/1993 | Briggs | A63G 31/007 | 482/35 |
| 5,221,243 | A * | 6/1993 | Walker | A63B 69/0053 | 482/83 |
| 5,405,294 | A * | 4/1995 | Briggs | A63B 9/00 | 482/35 |

(Continued)

*Primary Examiner* — Garrett K Atkinson

(74) *Attorney, Agent, or Firm* — Caseiro Burke LLC; Nicholas A. McCrillis

(57) ABSTRACT

The present invention relates to a kit used to configure, assemble, and reassemble play set apparatuses. More specifically, the present invention relates to a kit with several components which may be used in conjunction with one or more other components to form play set apparatuses. Still more specifically, the present invention relates to a kit with components that may be configured to form play set apparatuses including but not limited to a balance beam, a seesaw, a chair, a slide, and a rocking device.

4 Claims, 14 Drawing Sheets

(56) References Cited

U.S. PATENT DOCUMENTS 5,447,474 A * 9/1995 Chang ..... A63G 11/00 472/106
5,498,222 A * 3/1996 Hur ..... A63B 21/055 482/145
5,531,449 A * 7/1996 Denton ..... A63B 69/0097 273/348
5,776,002 A * 7/1998 Weber ..... A63G 11/00 472/110
5,951,406 A * 9/1999 Steane ..... A63G 11/00 472/111
6,447,429 B1 * 9/2002 Chen ..... A63B 22/18 482/79
6,527,645 B1 * 3/2003 Cline ..... A63B 9/00 472/117
7,300,110 B1 * 11/2007 Debien ..... A47D 9/053 297/440.13
7,704,200 B2 * 4/2010 Rahimi ..... A61H 1/0229 482/148
7,931,157 B1 * 4/2011 Palumbo ..... A47F 3/142 248/152
9,415,317 B2 * 8/2016 Hatfield ..... A63G 11/00
2004/0206014 A1 * 10/2004 Burginger ..... E04B 1/3211 52/80.1
2006/0128482 A1 * 6/2006 Habing ..... A63G 11/00 472/113
2007/0169429 A1 * 7/2007 Wu ..... A47C 4/03 52/405.4
2008/0280734 A1 * 11/2008 Dickie ..... A63B 22/0023 482/54
2010/0004100 A1 * 1/2010 Rahimi ..... A63B 23/0233 482/96
2011/0294635 A1 * 12/2011 Morris ..... A61H 1/005 482/146
2015/0051010 A1 * 2/2015 Schroer ..... A63B 69/3661 473/278
2016/0089609 A1 * 3/2016 Hatfield ..... A63G 11/00 472/112
2016/0230401 A1 * 8/2016 Bennett ..... A63B 69/02
2018/0154276 A1 * 6/2018 Oh ..... A63G 11/00
2020/0038771 A1 * 2/2020 Demas ..... A63H 33/008
2020/0211518 A1 * 7/2020 Voll ..... G10H 1/0556
2022/0032145 A1 * 2/2022 Rasmussen ..... A63B 67/06
2022/0241662 A1 * 8/2022 Burk ..... A63B 71/022

* cited by examiner

MULTI-FUNCTION AT-HOME PLAYSET KIT

BACKGROUND OF THE INVENTION

1. Field of the Invention

The invention relates to kits for play sets. More particularly, the present invention relates to kits for constructing multiple indoor and/or back yard playground assemblies. Such assemblies include, but are not limited to, balance beams, seesaws or teeter-totters, slides, chairs, and rocking devices.

2. Description of the Prior Art

Playground playsets are well known assemblies and typically include items such as slides, swing sets, balancing devices, and rocking devices. While items such as seesaws (also referred to as teeter-totters) and balance beams are common at playgrounds they tend to be awkward to install at residential homes, whether that be inside or outside, as the structures tend to take up space and, while fun and useful devices, individually they do not always provide enough function to warrant the space and cost.

What is needed, therefore, is a kit for multiple function playsets that include, among other items, seesaws and balance beams, and that are accessible at residential homes. What is further needed is a kit that is easy to install but is also cost effective and space effective.

SUMMARY OF THE INVENTION

The present invention is kit for multi-function playsets that are ideal for indoor and outdoor use at residential homes. The kit may include at least five core components including: a lateral beam; a semi-circular support; two linear supports, which in certain cases are used as feet for a balance beam or handlebars on a seesaw; and a tangential support member. The core components of the present invention may be assembled and reassembled to form various playset apparatuses including but not limited to a balance beam, a seesaw, a chair, or a balance board.

In a first combination, end supports attach to an underside of the lateral beam to form a conventional balance beam. In a second combination, the components of the kit are reassembled into a seesaw, with the semi-circular support attached to the underside of the lateral beam and the end supports transitioned to an upward position above the lateral beam. In a third combination, the semi-circular support is inserted through an opening in the tangential support member to form a chair. The semi-circular support may also be used on its own and, depending on how it is placed on a ground surface, it may be used, for example, as a balance board, a seat, a slide, a rocker, or a step.

The kit for a multi-function playset provides for the configuration of multiple different play apparatuses from a small number of components that are easily assembled, disassembled, moved, and stored. The present invention allows for a user to quickly and easily transition the apparatus from one item to another. Additionally, the present invention allows for the various combinations to be available with one set of components, thus reducing the cost and space required for storage and assembly.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

An embodiment of the present invention 100 is shown in FIGS. 1-16. The drawings detail one embodiment of the present invention; however, the present embodiment should not be construed as limited to the embodiments set forth herein.

Figure 1:
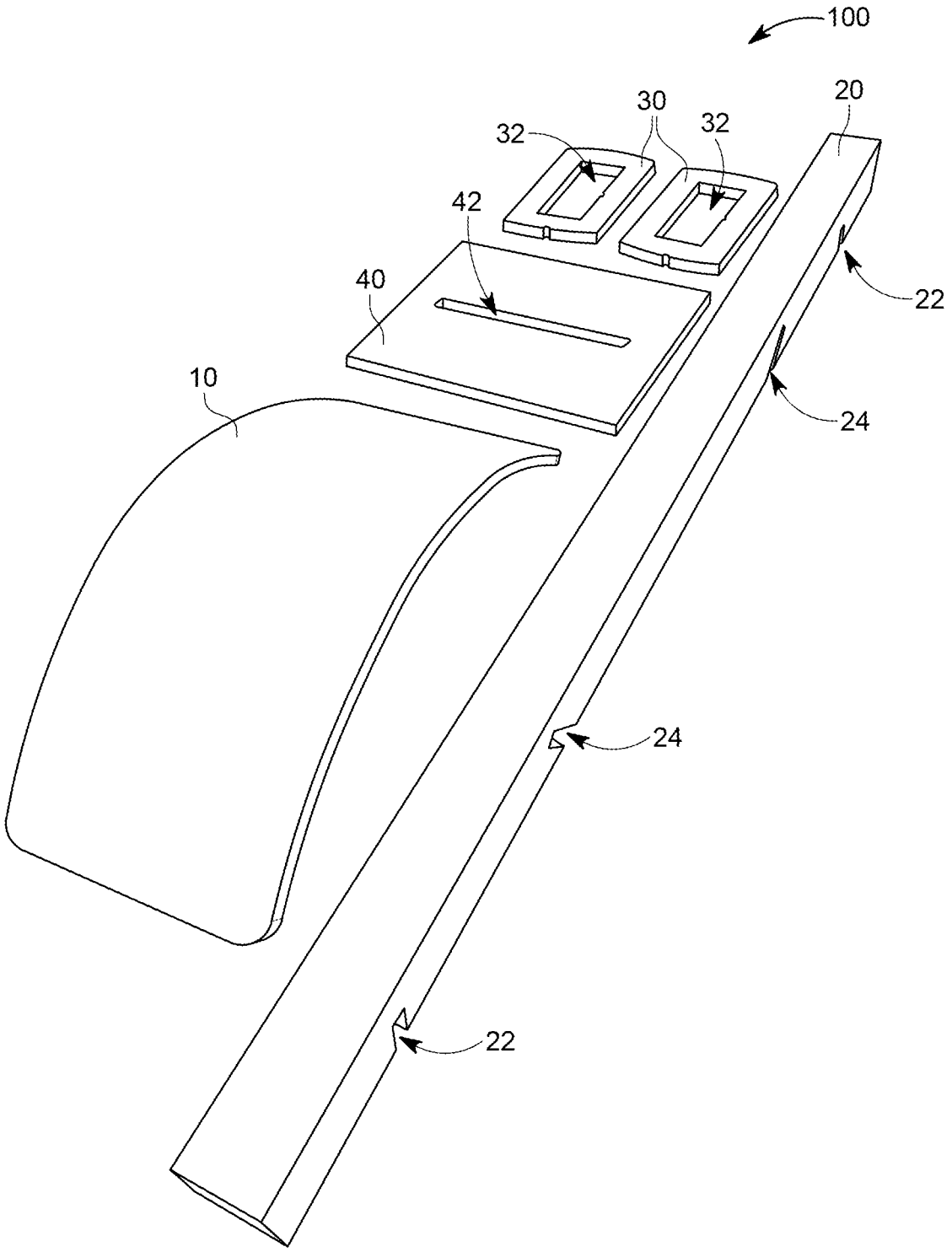
FIG. 1 is a top perspective view showing the components of the kit.
Figure 2:
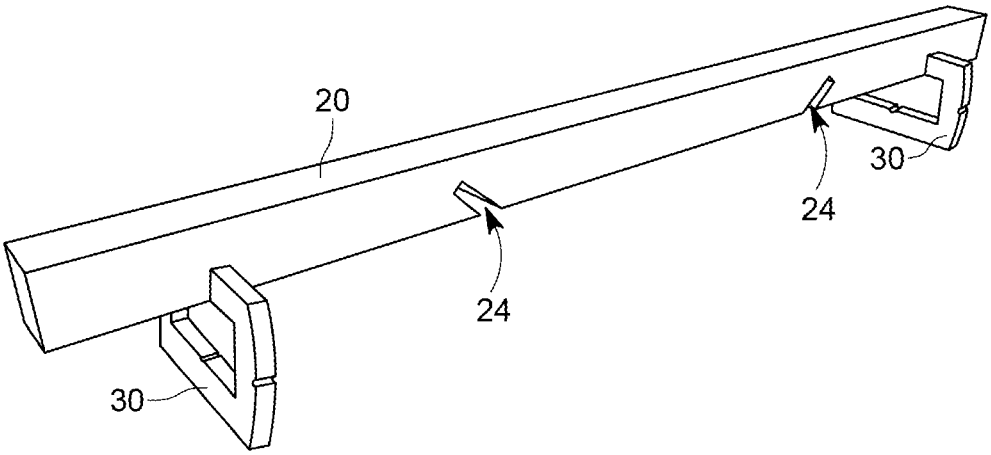
FIG. 2 is a side perspective view of the kit assembled in the form of a balance beam.
Figure 3:
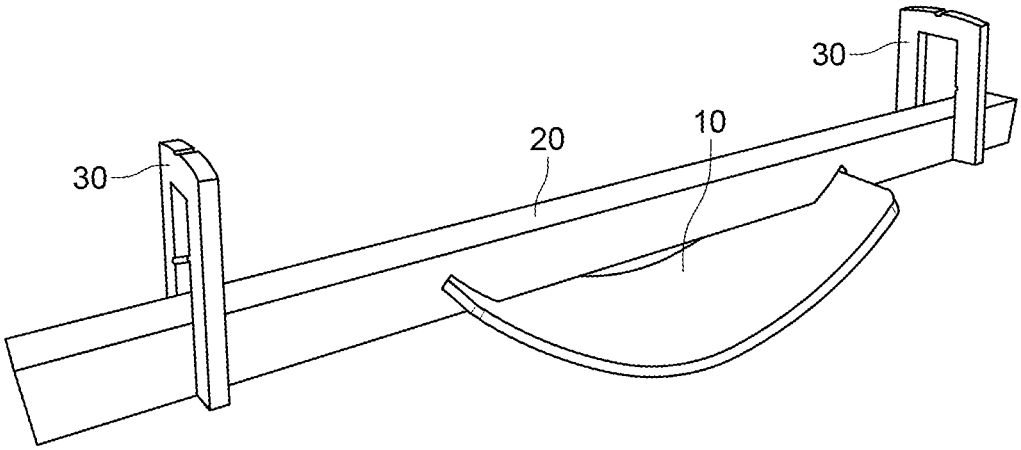
FIG. 3 is a side perspective view of the kit assembled in the form of a seesaw.
Figure 4:
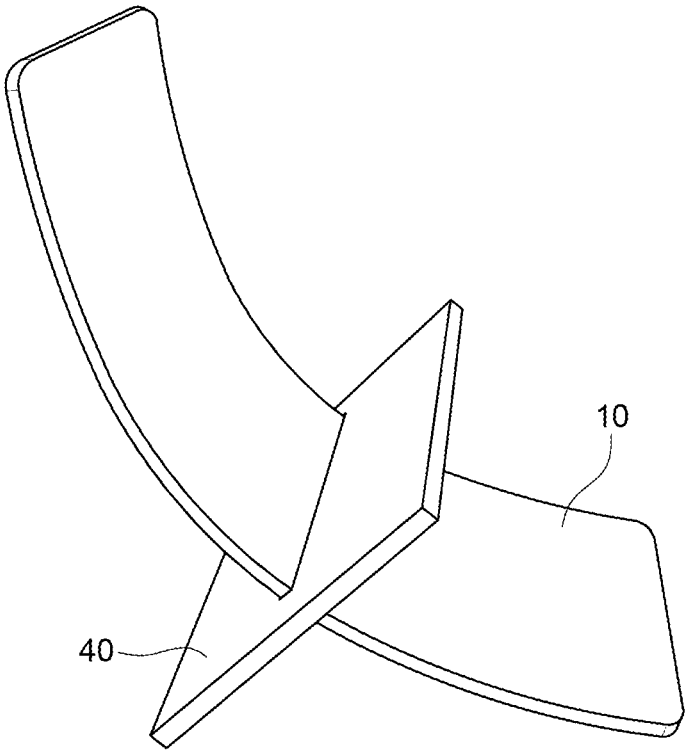
FIG. 4 is a side perspective of the kit assembled in the form of a chair.
Figure 5:
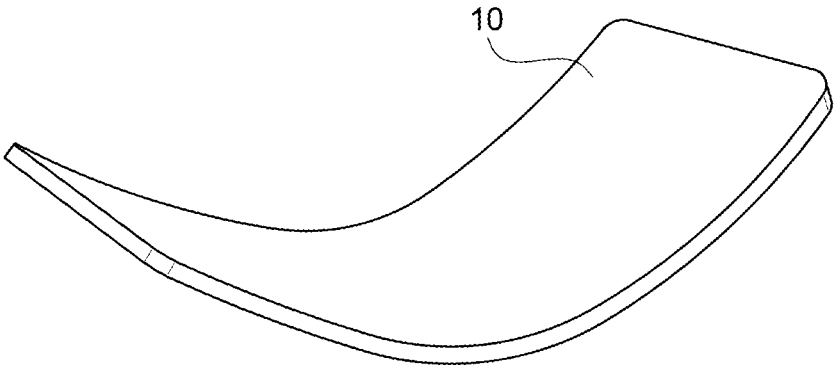
FIG. 5 is a side perspective view of the arc.

FIGS. 1-16 illustrate a kit for a multi-function playset 100. The components of the kit are configurable into a number of different assemblies, including, for example, a seesaw, a balance beam, a slide, a teetering arc, and a chair. FIG. 1 illustrates the components of the kit 100. The kid 100 has a semi-circle support 10 that is also referred to as an arc 10, a modified beam 20, linear supports 30, and a tangential support member 40. FIG. 2 illustrates components of the kit 100 assembled as a balance beam. FIG. 3 illustrates components of the kit 100 assembled in the form of a seesaw or teeter-totter. FIG. 4 illustrates components of the kit 100 in the form of a chair. The various components are easy to assemble and reconfigure. The kit 100 is sized and shaped to be easily used in a conventional residential home or in a residential yard.

The modified beam 20 includes a multitude of insertion slots. The present embodiment depicts the beam 20 with four insertion slots. Two of the insertion slots are linear support insertion slots 22 that have an approximately upward orientation in the bottom of the beam for attachment of the linear supports 30. In two primary configurations, the linear supports 30 attach to the modified beam 20 in different manners to serve as handles on a seesaw configuration or lower supports on the balance beam configuration. The other two insertion slots are arc insertion slots 24 and are angled and configured to couple with the arc 10 when the kit 100 is configured as a seesaw.

Figure 6:
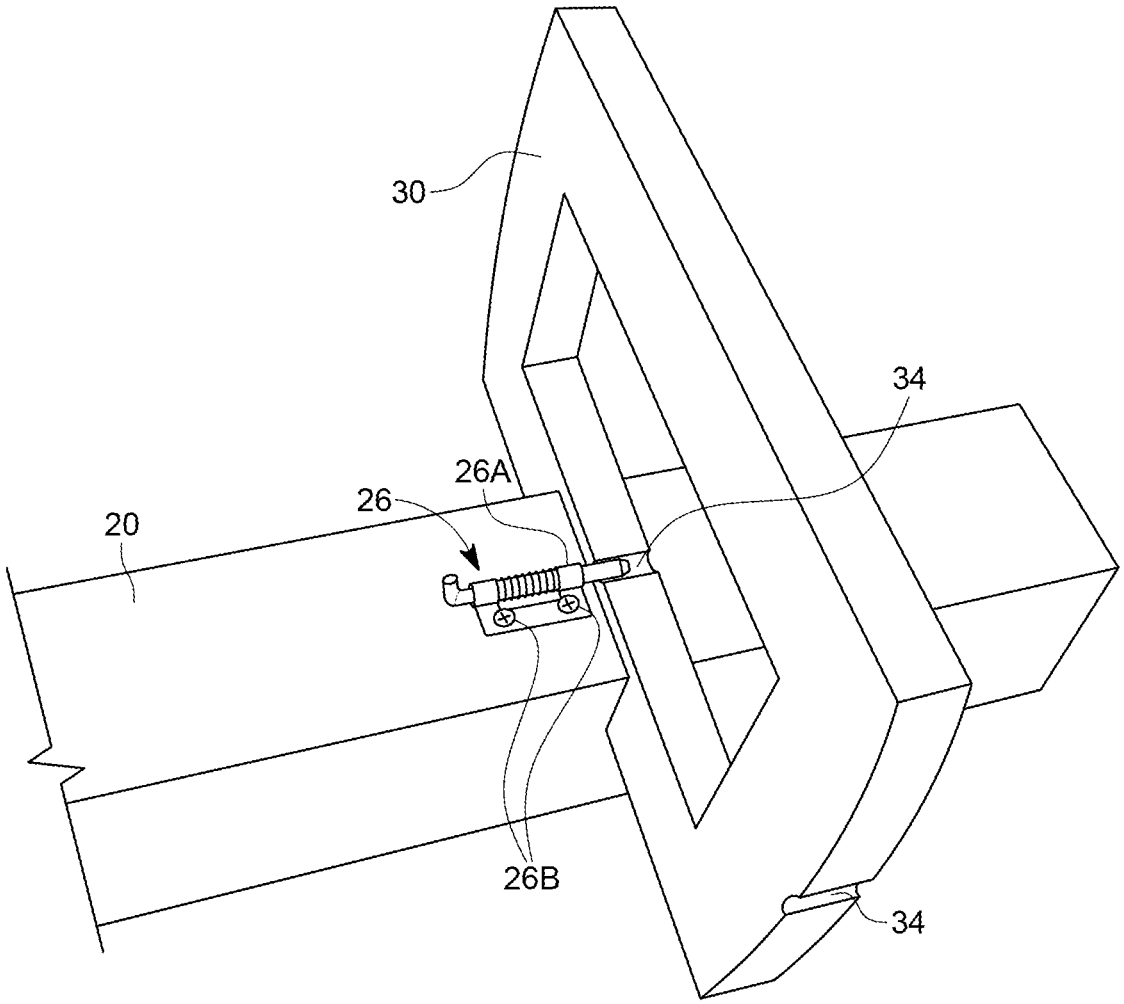
FIG. 6 is a bottom perspective view of the end of the balance beam secured to the linear supports.
Figure 7:
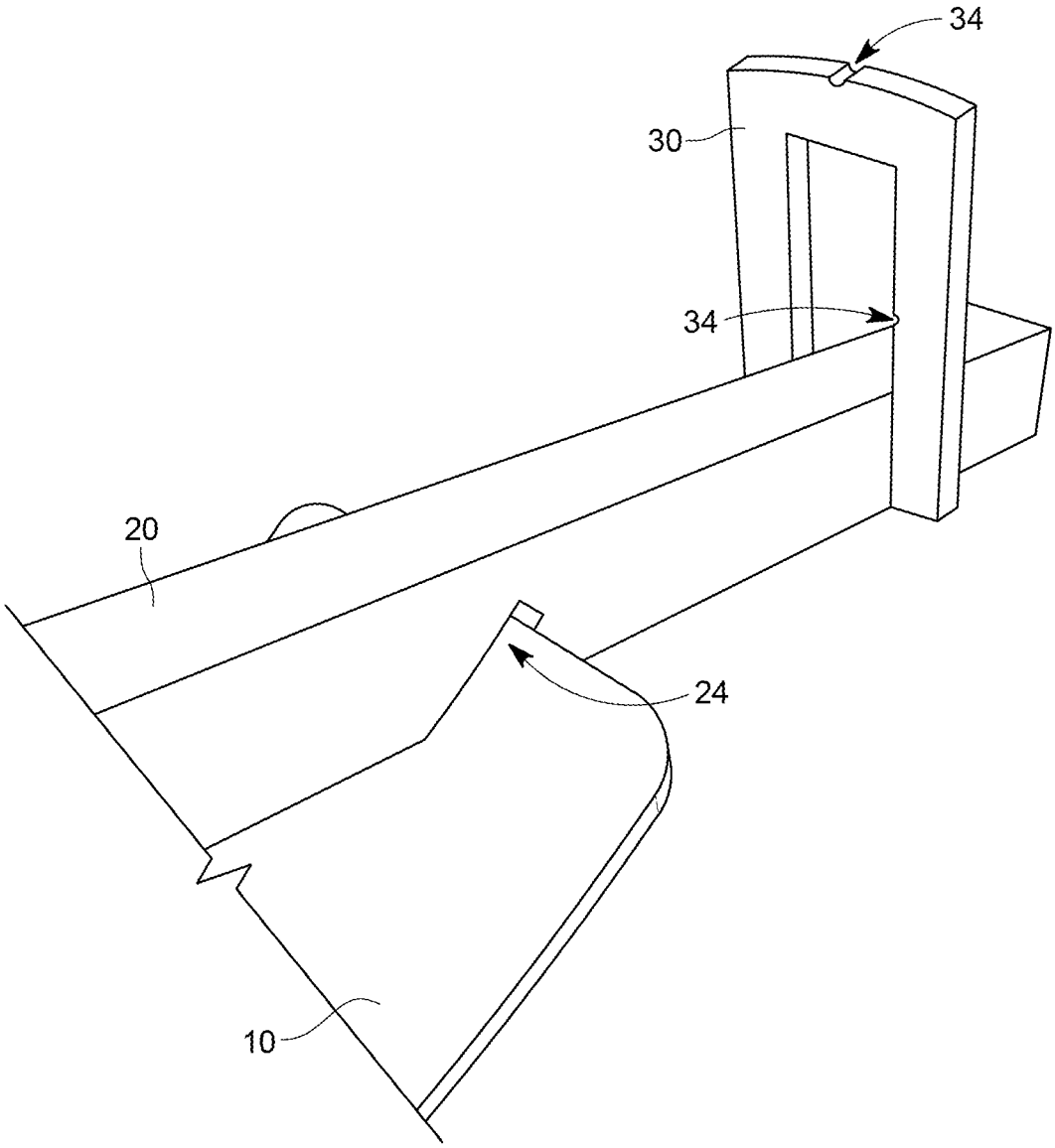
FIG. 7 is a side perspective view of one end of the seesaw.
Figure 8:
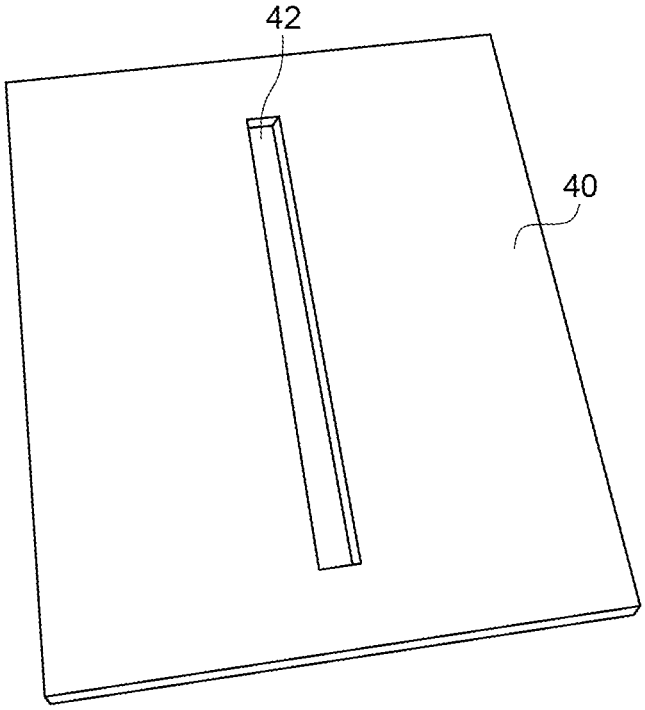
FIG. 8 is a top perspective view of the tangential support member.
Figure 9:
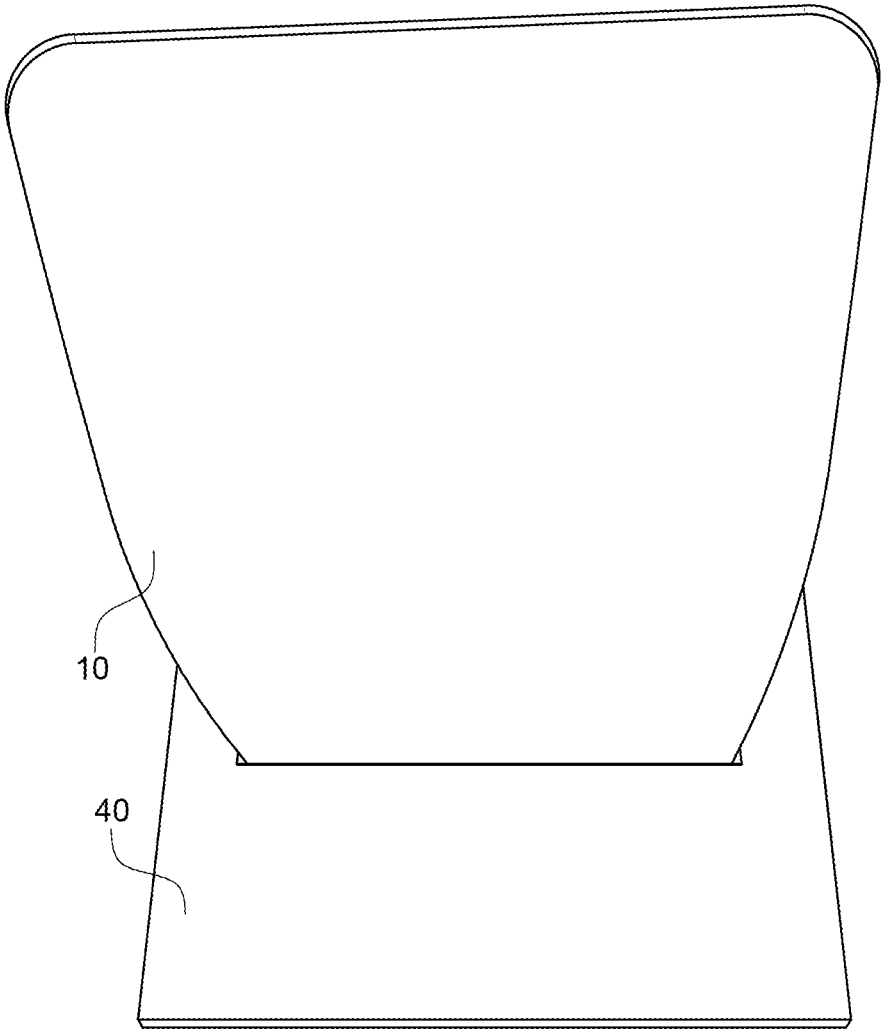
FIG. 9 is a back perspective view of the kit assembled in the form of a chair.
Figure 10:
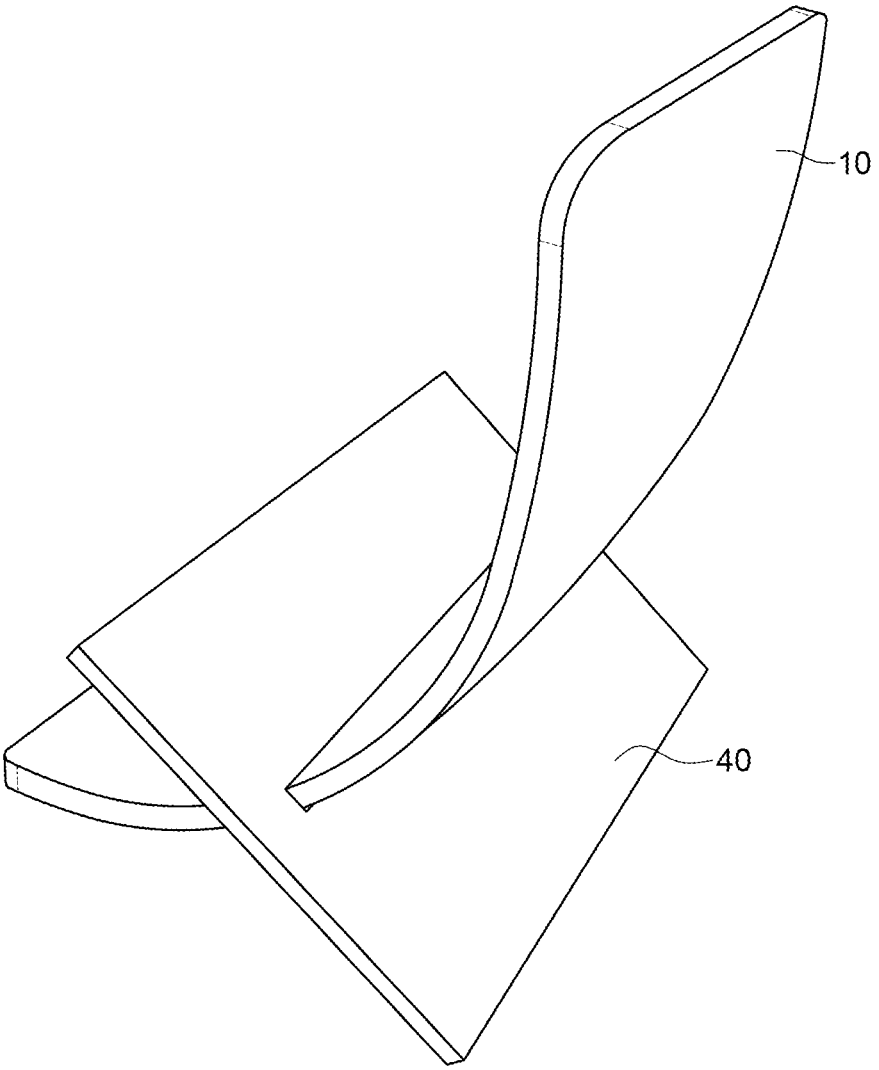
FIG. 10 is a side perspective view of the kit assembled in the form of a chair.
Figure 11:
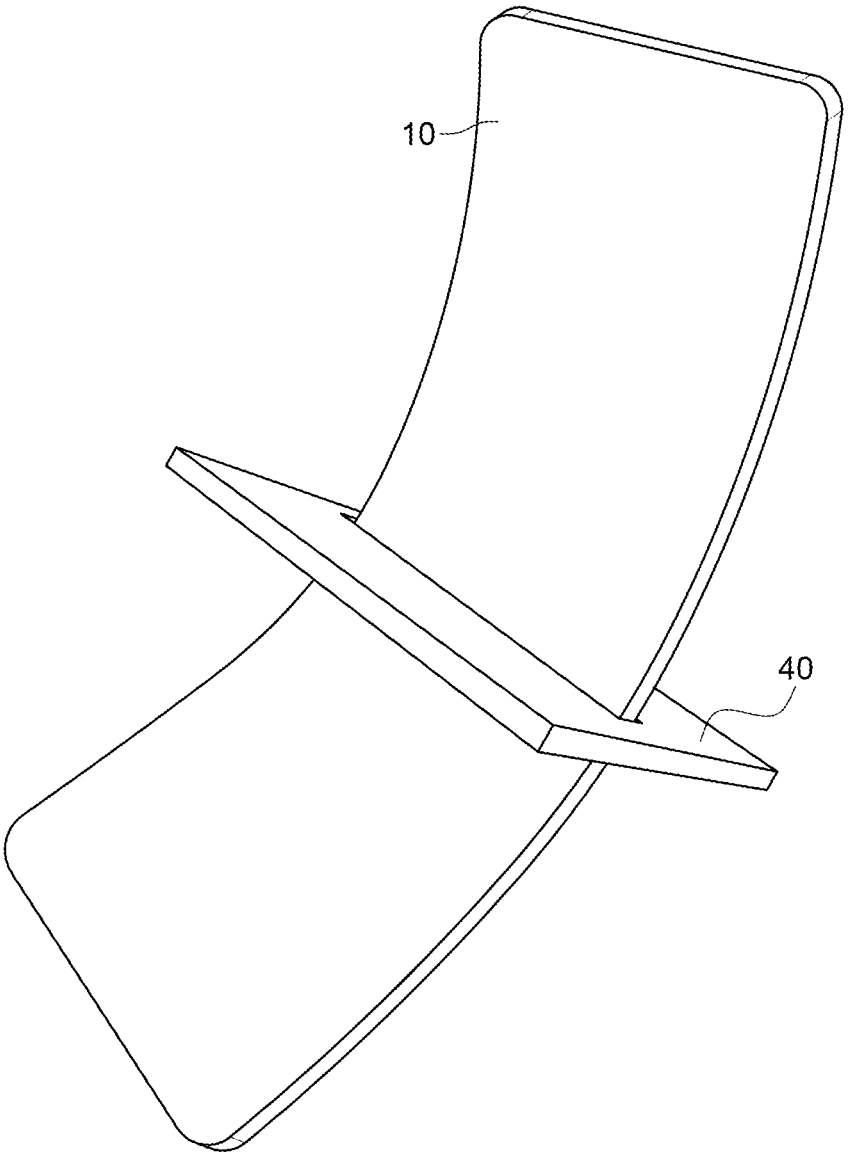
FIG. 11 is a side perspective view of the kit assembled in the form of a chair.
Figure 12:
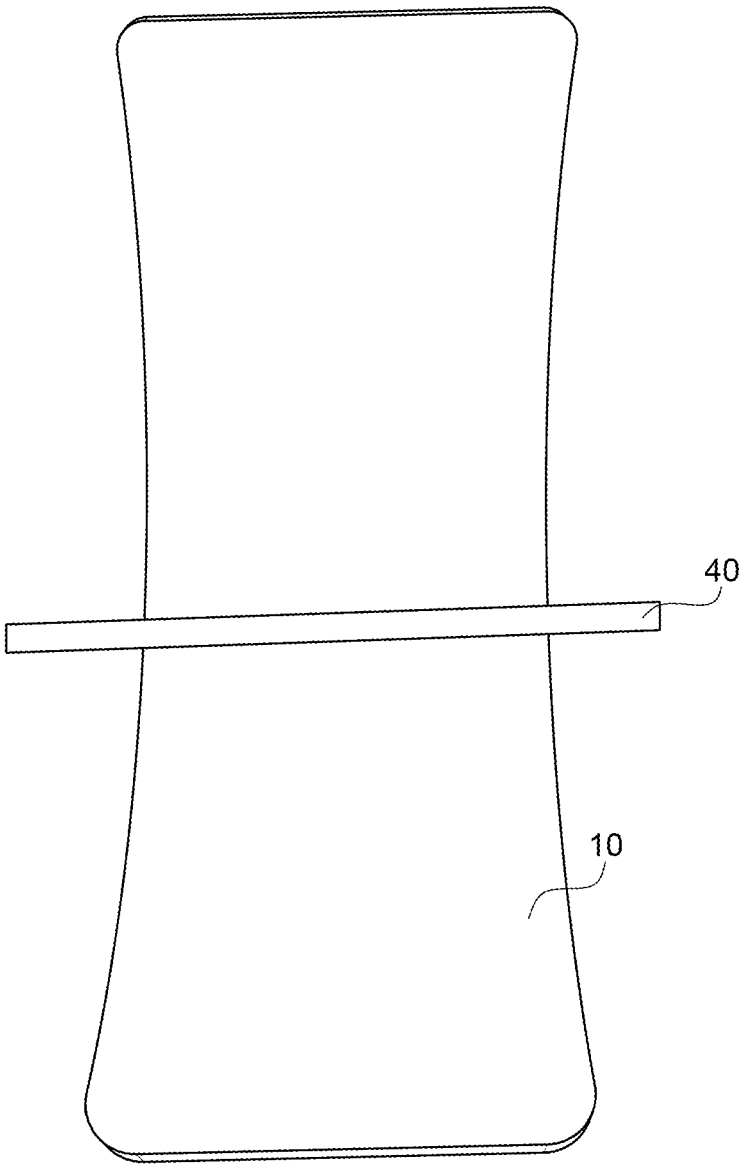
FIG. 12 is a front perspective view of the kit assembled in the form of a chair.
Figure 13:
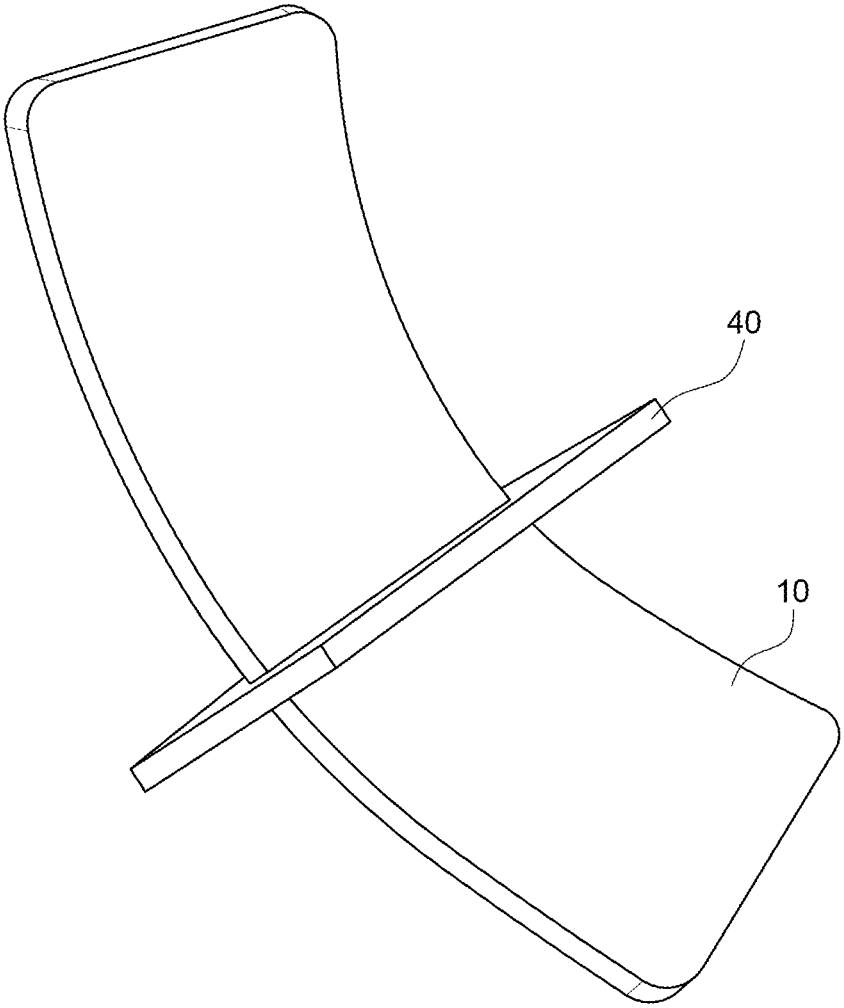
FIG. 13 is a side perspective view of the kit assembled in the form of a chair.
Figure 14:
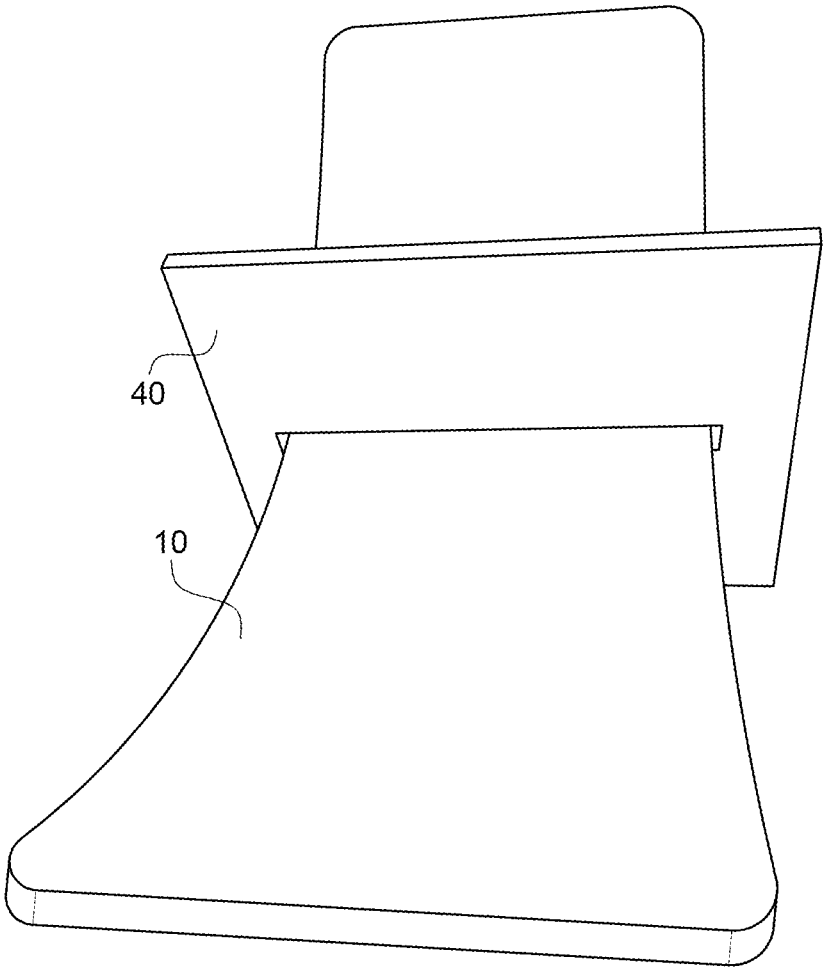
FIG. 14 is a bottom perspective of the kit assembled in the form of a chair.
Figure 15:
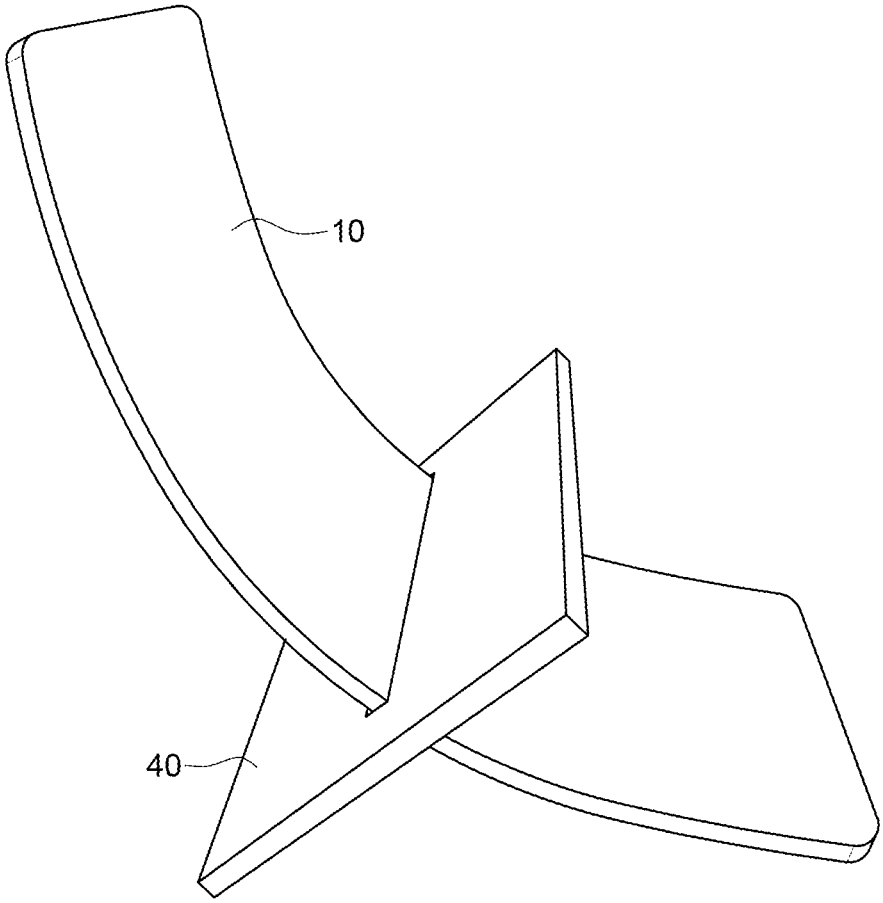
FIG. 15 is a side perspective view of the kit assembled in the form of a chair.
Figure 16:
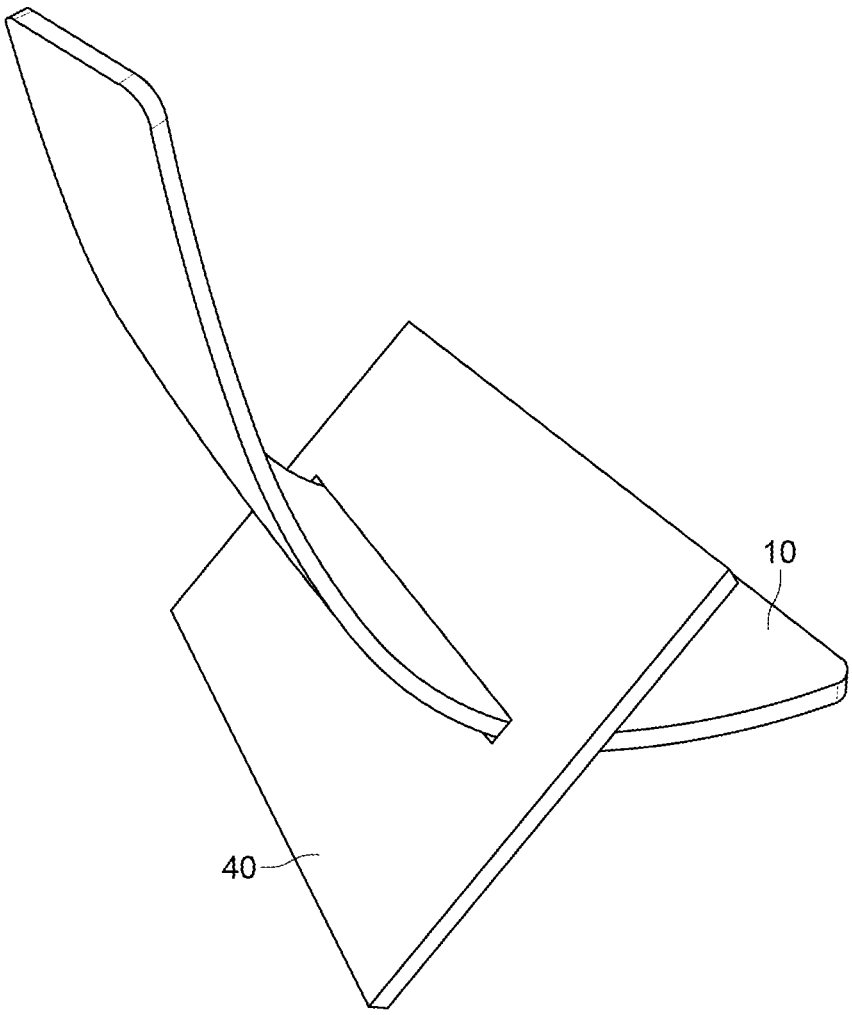
FIG. 16 is a side perspective view of the kit assembled in the form of a chair.

As shown in FIG. 6, the modified beam 20 also includes a locking mechanism 26 configured to releasably secure the linear supports 30 in the support insertion slots 22. In the present embodiment, the locking mechanism 26 is a slidable locking pin 26A that is secured to the modified beam 20 by threaded fasteners 26B.

The linear supports 30 are largely rectangular in shape having an opening 32 approximately located in the center of the support 30. The linear supports 30 are configured to attach to the beam 20 in multiple orientations, and each include one or more locking slots 34 that work in connection with the locking mechanism 26 of the modified beam 20. The locking pin 26A of the locking mechanism 26 that is a locking pin 26A slides over the locking slot 34 and is then locked in place to secure the linear support 30 to the modified beam 20.

As previously noted, the linear supports 30 may attach to the beam 20 in different manners based on the type of device being assembled from the kit 100. Typically, the linear support 30 is arranged in a horizontal manner with the longer sides on the top and bottom when the kit 100 is used to assemble a balance beam configuration. In this manner, the linear supports 30 provide a wide base to provide adequate support for the modified beam 20 in its position in the balance beam configuration. Conversely, when the kit 100 is used to in a seesaw configuration the linear supports 30 are transitioned to a vertical orientation, with the longer sides on the sides of the beam, to provide a handle that is at a convenient height for the users.

To assemble the kit 100 in a seesaw configuration, the arc 10 is inserted into the arc insertion slots 24 of the beam 20 where it is held in place by virtue of its fit with the beam 20. To create this secure fit, the angles of the slots 24 are made to fit tightly with the curve of the arc 10, with the arc 10 being coupled with the beam 20 via a side entry insertion.

The arc 10 may also be used on its own. For example, when placed on a surface with the curved side up the arc 10 may be used as a slide. Additionally, when the arc 10 is placed with its curved side down it may be used as a rocking device.

The tangential support 40 is a rectangular support member with an opening in the that is approximately the length and width arc 10. With these dimensions, the arc may be inserted into the opening 42 where it may be wedged into a desired position based on the curvature of the arc to create a chair, with the tangential support serving as the seat on the chair and the arc serving as the back rest. FIGS. 9-16 depict the use of the kit 100 in a chair configuration.

The components of the kit 100 may made from a variety of materials and come in a variety of sizes. For example, the kit may be made from a type of wood. In one embodiment, the components of the kit 100 are made from birch and poplar wood and coated in a polyurethane. The beam 20 may, for example, have a height and a width of roughly 3 inches and a length ranging anywhere from 5 to 8 feet. The arc 10 may come in a variety of sizes with a variety of curvatures. In an embodiment, an arc 10 that is 27 inches in length and 11 inches in width with 7 inches of curvature height of is sufficient.

The present invention has been described with reference to specific examples and configurations. The description is not to be taken in a limiting sense but is made merely for the purpose of illustrating the general principles of the invention, since the scope of the invention is best defined by the appended claims.

What is claimed is:

1. An apparatus adapted to be removably assembled into a plurality of configurations, the apparatus comprising:

a lateral beam component;

a semi-circular support component; and a multitude of linear support components;

wherein the components are configured to be removably assembled in at least two configurations, the at least two configurations including a seesaw configuration and a balance beam configuration;

wherein in the seesaw configuration, the lateral beam is assembled atop the semicircular support and one linear support is attached proximal each of end of the lateral beam in an upwardly extending manner such that a pair of users can sit on respective ends of the lateral beam, grasp a respective linear support as a handle, and pivot the device on the semi-circular support to perform a seesaw activity; and wherein in the balance beam configuration, the lateral beam is assembled without the semicircular support and with one linear support attached proximal each of end of the lateral beam in a downwardly extending manner such that at least one of the users can perform balance exercises.

2. The apparatus of claim 1 further comprising a tangential support member.

3. The apparatus of claim 2 wherein the semi-circular support and the tangential support member are configured to be removably assembled with the semi-circular support inserted into an opening of the tangential support member in a chair configuration.

4. The apparatus of claim 1 wherein the semi-circular support component is configured to be used as a rocking device or a slide.

* * * * *